US006397424B1

(12) United States Patent
Leung

(10) Patent No.: US 6,397,424 B1
(45) Date of Patent: Jun. 4, 2002

(54) TOOTHBRUSH

(76) Inventor: Kwok Wai Leung, Unit C, 22nd Floor, Block 1, Tung Chun Industrial Building, No. 9-11 Cheung Wing Road, Kwai Chung (HK)

( * ) Notice: Subject to any disclaimer, the term of this patent is extended or adjusted under 35 U.S.C. 154(b) by 0 days.

(21) Appl. No.: 09/458,329

(22) Filed: Dec. 10, 1999

(51) Int. Cl.[7] ..... A46B 9/04
(52) U.S. Cl. ..... 15/105; 15/167.1
(58) Field of Search ..... 15/105, 167.1

(56) References Cited

U.S. PATENT DOCUMENTS 4,253,212 A * 3/1981 Fujita ..... 15/167.1
4,341,230 A * 7/1982 Siahou
4,744,124 A * 5/1988 Wang
5,134,743 A * 8/1992 Hukuba
5,572,762 A * 11/1996 Scheiner
5,673,451 A * 10/1997 Moore ..... 15/105
5,924,159 A * 7/1999 Haitin ..... 15/105

* cited by examiner

*Primary Examiner*—Randall E. Chin
(74) *Attorney, Agent, or Firm*—Jackson Walker L.L.P.

(57) ABSTRACT

A toothbrush incorporates a directional inertia switching arrangement in its handle and has an electrical pressure switch that responds to bending of the brush. When the brush is used correctly to brush teeth up and down and sufficient pressure is simultaneously applied to operate the switch, LED's are caused to be switched ON and OFF. This switching ON and OFF serves to visually indicate and especially to train a young person to brush his teeth correctly.

5 Claims, 2 Drawing Sheets

TOOTHBRUSH

BACKGROUND OF THE INVENTION

1. Field of the Invention

The invention relates to toothbrushes.

2. Description of Prior Art

The invention relates more particularly to toothbrushes that emit light and/or sound when in use, and that are therefore particularly useful in monitoring use of the toothbrush and/or aiding in training young persons to brush their teeth correctly.

In U.S. Pat. No. 4,253,212 a toothbrush is disclosed in which a ball or short cylinder is slidable along inside an elongate hollow member, in a handle of a toothbrush, that can be used to provide electric switching. The switching is used to initiate the emission of light or sound due to movement of the handle backwards and forwards, as will take place in normal use during toothbrushing. U.S. Pat. No. 4,253,212 also discloses generating light or sound whenever the toothbrush is flexed, as will normally occur in use when bristles of the toothbrush are urged firmly against a user's teeth during use. The disclosed switching arrangement is relatively complex and costly.

SUMMARY OF THE INVENTION

It is an object of the invention to overcome or at least reduce this problem.

According to the invention there is provided a toothbrush having a hollow handle for housing a battery power supply, one or more light emitting diodes (LED), an integrated electrical circuit and a directionally responsive inertia switching arrangement mounted in the handle, a shank extending from the handle to a brush head with an array of bristles, in which the switching arrangement includes an elongate resilient electrical conductor anchored at one end and constrained to oscillate in a plane parallel to axes of the bristles and acts to open and close an electrical circuit due to brushing movements of the toothbrush to turn the LED's ON and OFF.

The conductor may be a coiled spring. A plastics channel that may be provided that surrounds the conductor along its length to physically constrain oscillations of the conductor to the plane parallel to the axes of the bristles.

An electrical buzzer may be included in the housing that is initiated by the opening and closing of the circuit.

The toothbrush may include an electrical pressure switch that is arranged to close, whenever the handle is held and the bristles of the brush are firmly urged against surfaces of a user's teeth, due to relative bending between the handle and the shank.

The integrated circuit is preferably programmed to turn the LED's ON and OFF in response to the inertial switching arrangement only when the electrical pressure switch is either closed or closed intermittently.

BRIEF DESCRIPTION OF THE DRAWINGS

A toothbrush according to the invention will now be described by way of example with reference to the accompanying drawings in which.

DESCRIPTION OF THE PREFERRED EMBODIMENT

Figure 1:
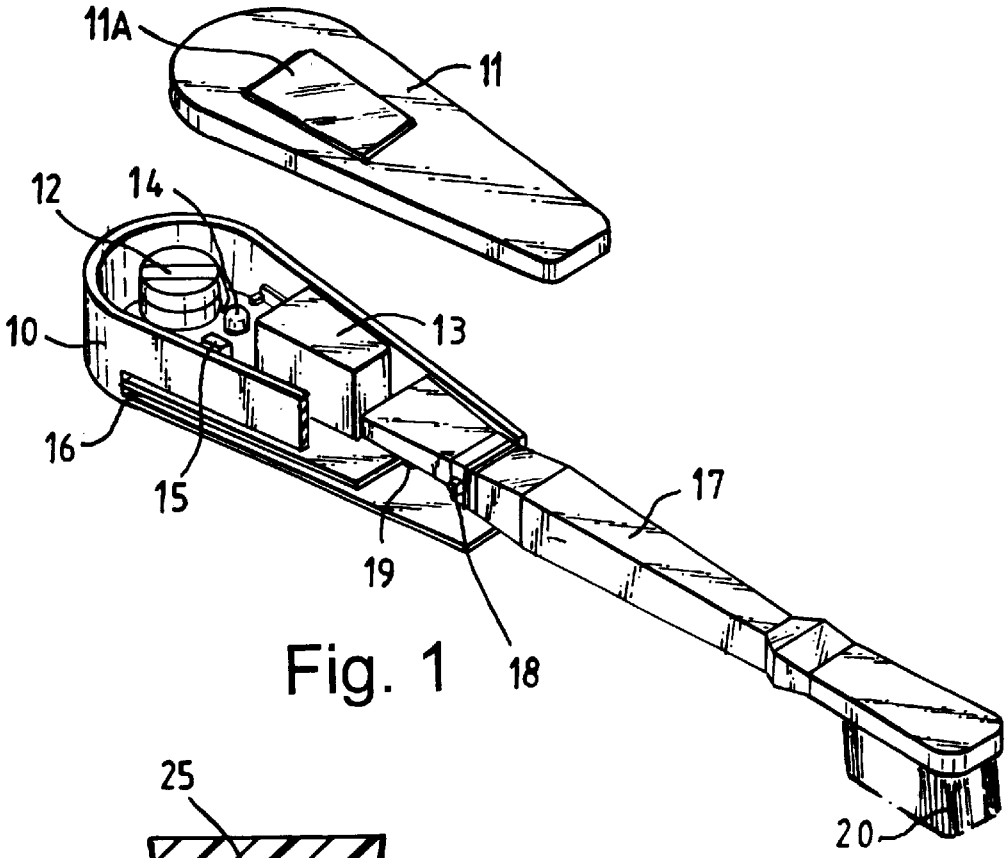
FIG. 1 is a part cut-away top isometric view of the toothbrush with a cover removed.

Referring to the drawings, in FIG. 1 a hollow toothbrush handle 10 that is normally closed by a lid 11 (which may be provided with an LED 11A) houses a battery 12 and an inertial electrical switch arrangement 13. Two LED's 14 (only one can be seen in FIG. 1) which are visible in use externally of the handle are mounted inside the handle. A buzzer 15 is also mounted inside the handle above an integrated circuit 16. A shank 17 is pivotably mounted by opposing stub axes 18 (only one stub axles is shown) at one end of the shank to the handle 10. The shank 17 extends to a brush head supporting a set of conventional bristles 20.

Figure 2:
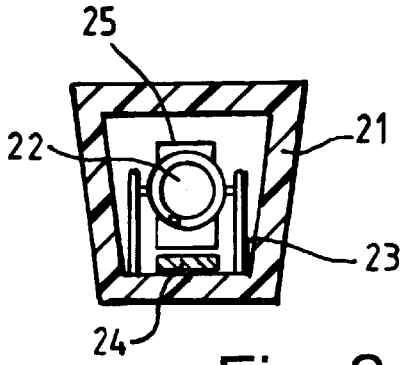
FIG. 2 shows an end sectional view of an inertia electrical switching arrangement for the toothbrush.
Figure 3:
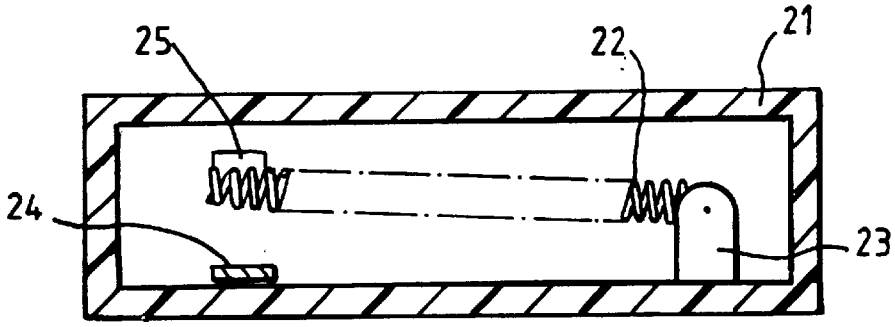
FIG. 3 shows a side sectional view of the inertia electrical switching arrangement.

In FIGS. 2 and 3, the inertial switching arrangement comprises a plastics housing 21 in which an electrically conductive coiled spring 22 is supported at one end to an electrical terminal 23. A second electrical terminal 24 is in the form of a plate mounted at the base of the housing. A small weight 25 is fixed at a remote end of the spring 22. When the toothbrush is moved up and down, that is with the bristles 20 moving up and down against the surfaces of the teeth, the spring 22 will vibrate and periodically, in synchronism with the brush movement, contact the plate 24. This contact "make and break" provides an electrical switching action illustrated by the switch 13 in FIG. 4. The spring 22 will also vibrate as the toothbrush is moved backwards and forwards in use. Such vibrations will not bring the spring into contact with the plate 24 and are physically restrained in effect by the sides of the housing at either side of the spring. Thus, the inertial switching arrangement is less sensitive to backwards and forwards brushing actions. In any event, such brushing action will not cause the toothbrush to emit light or sound. Thus, only when efficient (up and down) brushing takes place is the user advised, or rewarded perhaps, by flashing lights or appropriate sound emissions.

Figure 4:
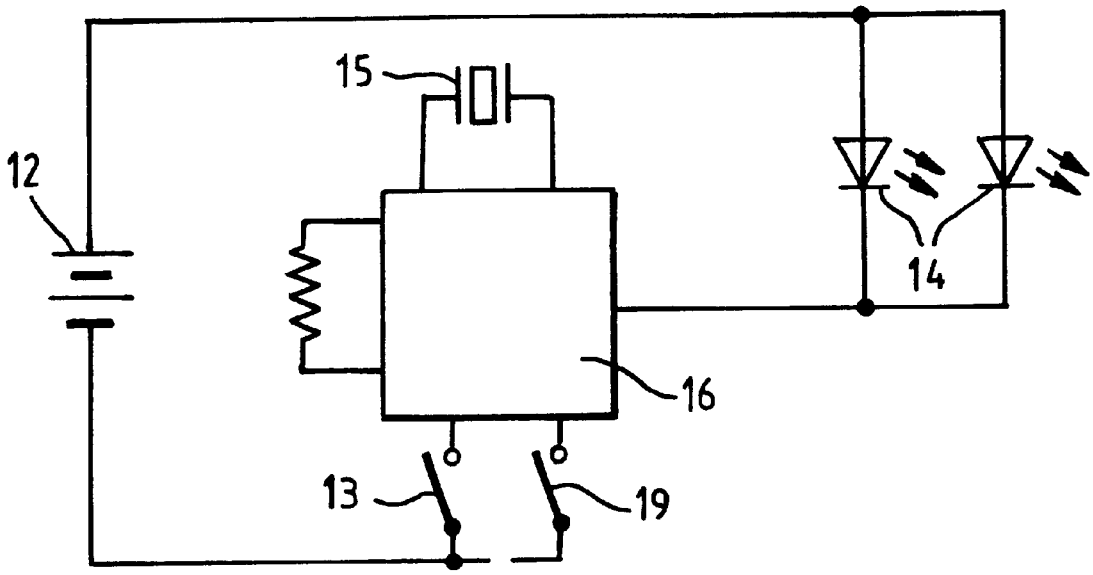
FIG. 4 is a circuit diagram of an electrical circuit for the toothbrush.

A circuit diagram in FIG. 4 shows the principle circuit connections and it is noted that in the described embodiment the switching arrangement 13 to input ports of the integrated circuit 16. In practice, the toothbrush must be somewhat bent (as explained below) to close an electrical pressure switch 19 before the operation of the switching arrangement 13 has any effect. In any event, when the toothbrush is moved up and down, the inertial switching arrangement 13 vibrates so that the switching arrangement makes and breaks. The integrated circuit 16 responds to this and causes the LED's 14 to be turned ON and OFF and initiates the buzzer 15. The toothbrush may be provided with either one or more LED's or the buzzer only where preferred.

Figure 5:
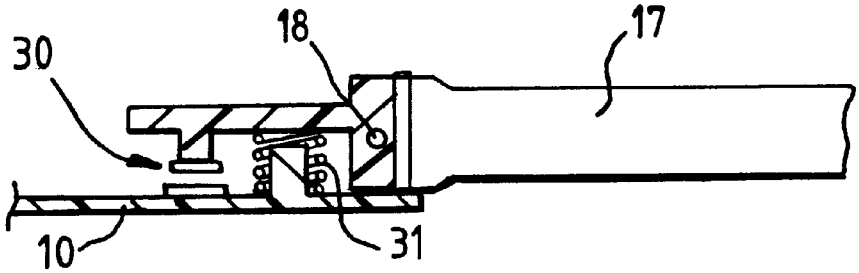
FIG. 5 shows a part-sectional elevation of one electric switch for the toothbrush.

In FIG. 5, the switch 19 is shown and includes two electrical contacts or terminals 30 that are normally held apart by the action of a coiled spring 31. When sufficient pressure is applied to the bristles of the toothbrush by a user holding the handle against his teeth, the toothbrush will in effect bend to some extent. This moves the shank 17 about its stub axles 18 and relative to the handle 10 causing the contacts 30 (constituting the switch 19 in FIG. 4) to close.

Figure 6:
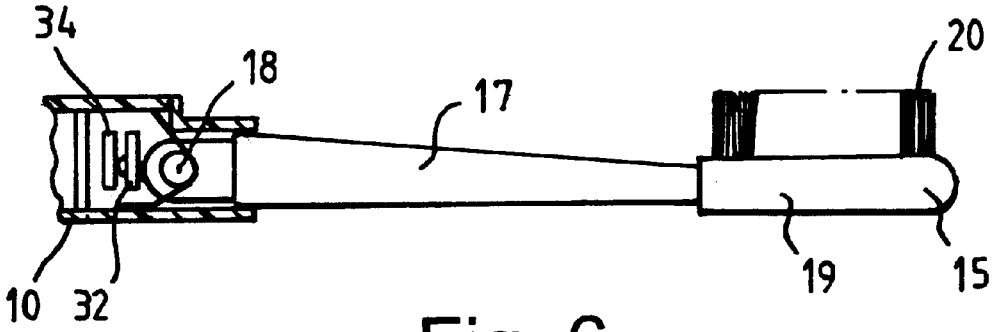
FIG. 6 shows a part-sectional view of an alternative switch for the toothbrush.

FIG. 6, an alternative form 19A of switch 19 of FIG. 4 is shown. In FIG. 6 when the shank 17 is pivoted by being pressed against the teeth, a protruding spur 32 urges a resiliently biased contact 33 against a fixed terminal 34 to close the alternative switch 19A.

Thus, in use whenever the toothbrush is urged with sufficient pressure against surfaces of the teeth, and moved at a reasonable speed up and down, the LED's 14 will light up, switching ON and OFF, and the buzzer 15 will sound. It will be noted that the switch 19 might not be held fully closed all the time that a correct brushing is being carried out. Therefore the buzzer 15 is often arranged to respond positively provided the switch 19 is at least closed intermittently.

The coiled spring 22 may be replaced by a springy length of straight wire or a narrow thin conductive plate. Likewise, a small weight 25 may be attached at its remote end away from an anchored end to aid the vibratory effect. The anchored end is fixed in a manner to allow the remote end of the wire to oscillate freely in a plane parallel to the axes of the bristles 20. The anchor fixing prevents or severely restrains the remote end oscillating in a plane transverse to the axes of the bristles.

The handle may be provided with a small LCD or like display and the integrated circuit programmed to provide images for the display. One image could be representative that the correct tooth brushing procedure is taking place. Another image may be generated whenever the toothbrush is being used but being manipulated with an incorrect brushing action, for example.

I claim:

1. A toothbrush comprising:

a hollow handle for housing a battery power supply;

at least one light emitting diode;

an integrated circuit and a directionally responsive inertia switching arrangement mounted in the handle;

a shank extending from the handle to a brush head with an array of bristles wherein the switching arrangement further comprises:

an elongate resilient electrical conductor anchored at one end and constrained to oscillate in a plane parallel to axes of the bristles and open and close an electrical circuit due to brushing movements of the toothbrush to turn the at least one light emitting diode ON and OFF; and a plastic channel surrounding the conductor along its length to physically constrain oscillations of the conductor in the plane parallel to the axes of the bristles.

2. A toothbrush according to claim 1, wherein the conductor is a coiled spring.

3. A toothbrush according to claim 1, further comprising: an electrical pressure switch arranged to close, whenever the handle is held and the bristles of the brush are firmly urged against surfaces of a user's teeth pivoting the shank.

4. A toothbrush according to claim 3, wherein the integrated circuit is programmed to turn the at least one light emitting diode ON and OFF in response to the inertia switching arrangement only when the electrical pressure switch is also closed.

5. A toothbrush according to claim 3, wherein the integrated circuit is programmed to turn the at least one light emitting diode ON and OFF in response to the inertia switching arrangement only when the electrical pressure switch is intermittently closed.

* * * * *